US007090150B2

(12) United States Patent
Amaduzzi

(10) Patent No.: US 7,090,150 B2
(45) Date of Patent: Aug. 15, 2006

(54) ACTIVATING MECHANISM FOR AN INTERCEPT VALVE FOR A SPRAY GUN USED IN WATER CLEANER APPARATUS

(75) Inventor: Roberto Amaduzzi, Rubiera (IT)

(73) Assignee: Arrow Line S.R.L., Rubiera (IT)

( * ) Notice: Subject to any disclaimer, the term of this patent is extended or adjusted under 35 U.S.C. 154(b) by 0 days.

(21) Appl. No.: 10/671,765

(22) Filed: Sep. 29, 2003

(65) Prior Publication Data

US 2004/0118947 A1 Jun. 24, 2004

(30) Foreign Application Priority Data

Dec. 19, 2002 (IT) ..... RE2002U0039

(51) Int. Cl.
*B05B 7/02* (2006.01)

(52) U.S. Cl. ..... 239/526; 239/586; 251/238

(58) Field of Classification Search ..... 239/526–528, 239/586; 222/470, 472, 473, 474, 505, 515; 251/237, 238

See application file for complete search history.

(56) References Cited

U.S. PATENT DOCUMENTS 1,797,209 A * 3/1931 Bramsen et al. ..... 239/415
2,958,471 A * 11/1960 Zippel ..... 239/414
3,698,644 A * 10/1972 Nystuen ..... 239/318
4,005,824 A * 2/1977 Becker et al. ..... 239/289
5,662,273 A * 9/1997 Chih ..... 239/526
5,979,800 A * 11/1999 Takagi ..... 239/440

FOREIGN PATENT DOCUMENTS

| | | |
|---|---|---|
| GB | 842959 | 8/1960 |
| WO | WO 95/11760 | 5/1995 |

* cited by examiner

*Primary Examiner*—Christopher Kim
(74) *Attorney, Agent, or Firm*—Young & Thompson

(57) ABSTRACT

The activating mechanism comprises a manually-operated control lever rotatably constrained at a first end thereof to a pivot arranged in proximity of a front portion of a handle grip of a spray gun and an activating lever acting on a pusher element of an intercept valve. The activating lever has a first end portion which is rotatably constrained on a hinging pivot arranged in proximity of a back portion of the handle grip and a second end portion which is operatively constrained to the control lever.

5 Claims, 2 Drawing Sheets

ACTIVATING MECHANISM FOR AN INTERCEPT VALVE FOR A SPRAY GUN USED IN WATER CLEANER APPARATUS

BACKGROUND OF THE INVENTION

In the field of spray guns for water cleaner apparatus, the activating mechanism of intercept valves associated to the guns generally comprises a control lever hinged to the handle grip of the gun and destined to open the intercept valve. If the intercept valve is located in proximity of the front portion of the handle grip, the lever is generally rotatably hinged at a pivot, which is also situated close to the front portion of the handle grip.

The front lever hinge is advantageous from an ergonomic point of view since it is easier for the human hand to squeeze a lever diverging from a grip at a front part of the hand, i.e. starting from the position of the index finger, rather like when using a brake lever on a bicycle.

As it has been seen to be advantageous to locate the intercept valve, in particular a valve having a ball obturator, close to a posterior portion of the spray gun, the prior art has placed the control lever, in these cases, in the same posterior part of the handle grip.

The above technical solution, it is stressed, is the best possible position for the intercept valve which, among other things, not only enables a posterior location of the fluid supply tube, but also enables use of non-stainless steel internal conduits, since the rust forming in the conduits, being downstream of the valve, could not come into contact with the valve itself.

However, the above technical solution has the drawback of being poorly ergonomic as it is uncomfortable to squeeze a lever which diverges from the back end of the handle grip.

For the above reason the technical solution of using a control lever hinged to the back part of the grip has up to now seldom been proposed.

The main aim of the present invention is to provide an activating mechanism for an intercept valve which overcomes the mentioned drawbacks.

An important aim of the present invention is to provide an activating mechanism for an intercept valve which preserves the high performance and good ergonomic characteristics of mechanisms having the control lever hinged to the front part of the grip of a spray gun, even where the intercept valve is located in a best position therefor, i.e. in the posterior portion of the handle grip.

A further important aim of the invention is to provide an activating mechanism having a simple structure and being reasonably economical to produce.

A further aim is to provide a highly-reliable activating mechanism having good resistance characteristics with regard to the stress it is placed under. The technical aims are achieved by an activating which is characterised in that it comprises one or more of the technical solutions described in the accompanying claims.

SUMMARY OF THE INVENTION

The activating mechanism comprises a manually-operated control lever rotatably constrained at a first end thereof to a pivot arranged in proximity of a front portion of a handle grip of a spray gun and an activating lever acting on a pusher element of an intercept valve. The activating lever has a first end portion which is rotatably constrained on a hinging pivot arranged in proximity of a back portion of the handle grip and a second end portion (10*b*) which is operatively constrained to the control lever.

BRIEF DESCRIPTION OF THE DRAWINGS

A non-limiting example of the invention is now described, in a preferred but non-exclusive embodiment of the activating mechanism of the invention, illustrated by way of example in the accompanying figures of the drawings, in which.

DESCRIPTION OF THE PREFERRED EMBODIMENTS

Figure 1:
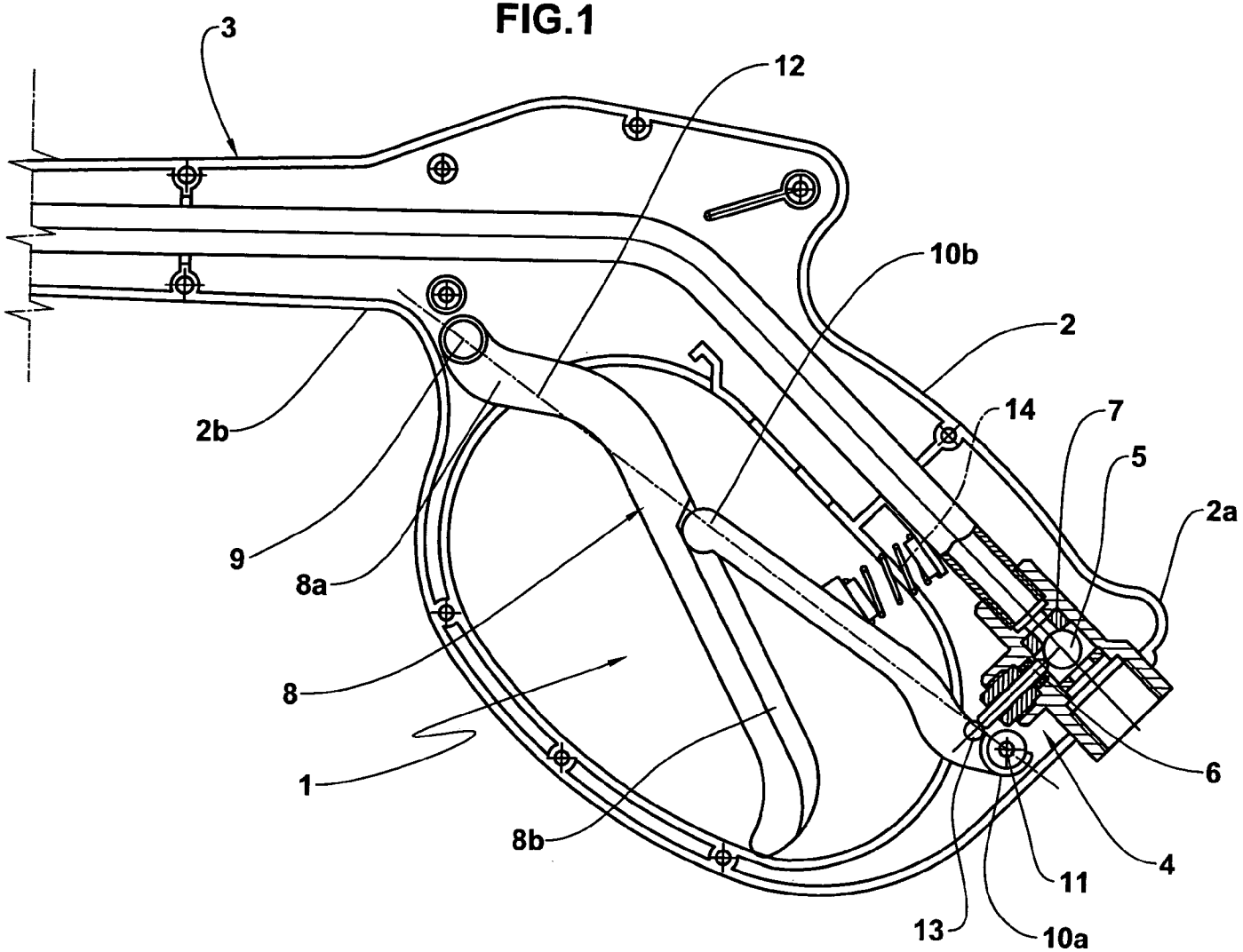
FIG. 1 is a longitudinal section of the handle grip of a spray gun exhibiting an activating mechanism of the present invention arranged in a first rest position corresponding to a closed position of the intercept valve of the gun.
Figure 2:
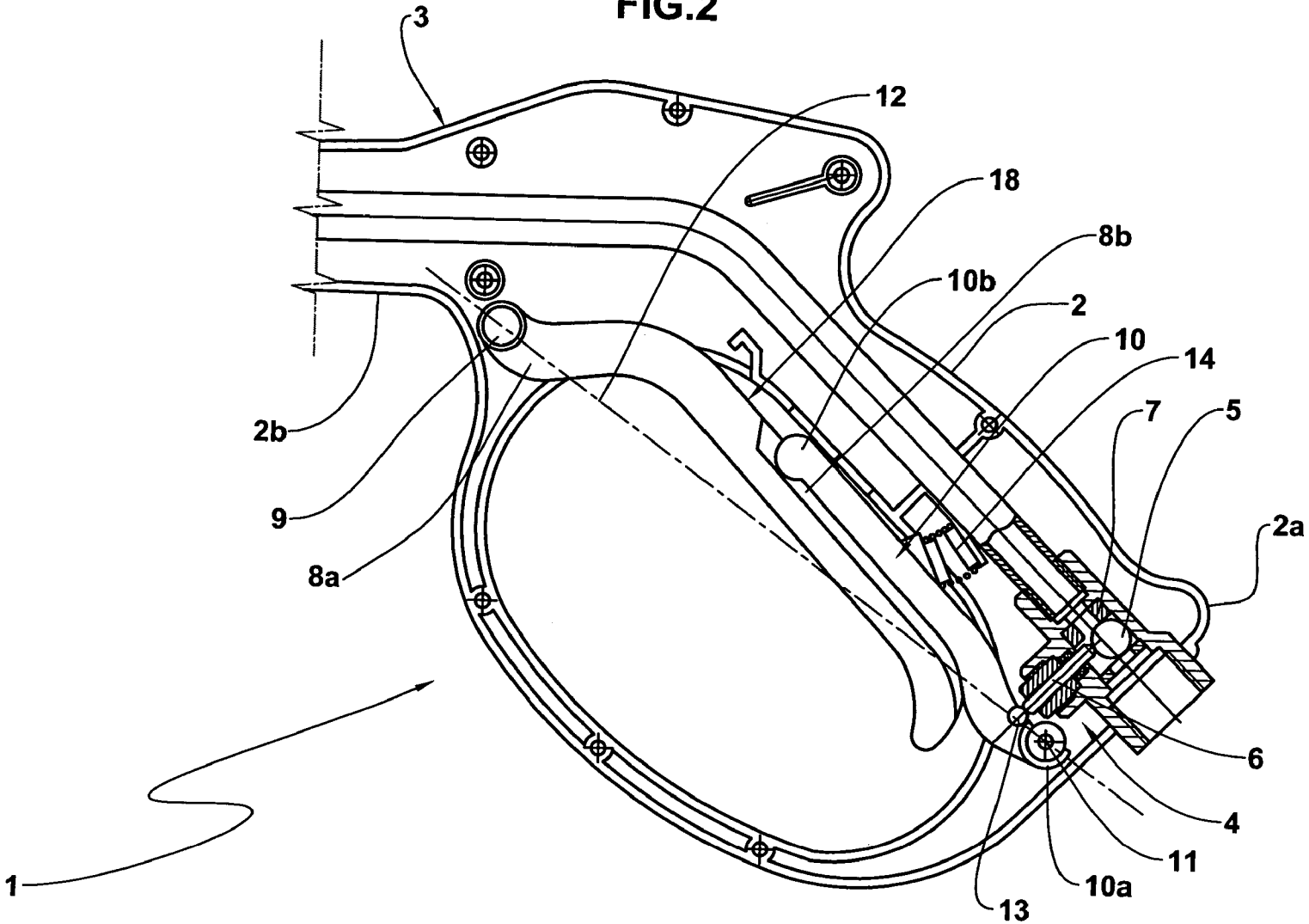
FIG. 2 is the same section as in FIG. 1, in which the activating mechanism is arranged in an operative position with the intercept valve in the open position.

With reference to the figures of the drawings, the activating mechanism of the invention is denoted in its entirety by number 1.

The activating mechanism is associated to the handle grip 2 of a spray gun 3 provided with an intercept valve 4, advantageously having a ball obturator as described in a further patent application of the present applicant.

The intercept valve 4 is arranged at a posterior portion 2*a* of the grip 2 and comprises a control element for changing the valve from closed to open and to closed once more, constituted by a pusher element 6 laterally disposed with respect to the liquid flow direction and destined to press on the ball obturator 5 in order to detach it from an annular seating 7 on which the ball obturator 5 rests when the intercept valve 4 is in the closed position.

The activating mechanism 1 comprises a control lever 8 which can be pressed by a user's fingers and is rotatably constrained at a first end thereof 8*a* to a pivot 9 arranged in proximity of a front portion 2*b* of the grip 2.

The dimensions, conformation and position of the hinge of the control lever 8 are established mainly on the criterion of ergonomics.

An activating lever 10, acting on the pusher element 6 of the intercept valve 4, exhibits a first end portion 10*a* constrained rotatably to a hinge pivot 11 arranged in proximity of the back portion 2*a* of the grip 2 and a second end portion 10*b* constrained to the control lever 8. More precisely, the control lever 8 exhibits a groove 8*b* which houses the second end portion 10*b* of the activating lever 10, allowing sliding contact of the activating lever 10 with the control lever 8.

The length of the activating lever 10 is determined during the design phase so as to arrange the second end portion 10*b* of the activating lever 10 along an axis 12 passing through the pivot 9 and for the hinging pivot 11.

The above-described alignment means that the reciprocal sliding between the control lever 8 and the second end portion 10*b* of the activating lever 10 can be kept to a minimum, with the aim of limiting wear on the mechanical parts and thus increasing working life and reliability thereof.

To contain the considerable contact pressure developing between the activating lever 10 and the pusher element 6 of the intercept valve 4, a hardened steel pin 13 is included, inserted in the activating lever 10. The length of the steel pin 13 and the length of the hinging pivot 11 are determined in order to limit as much as possible the dragging between the pin 13 and the pusher element 6, thus reducing wear.

In order for the activating mechanism to return to the rest position (see FIG. 1), when the water cleaner apparatus is not in use and the hydraulic thrust bearing on the pusher element is not present, at least one elastic element can be provided, preferably a spring 14 which acts, for example, on the activating lever 10.

In the figures of the drawings, the spring 14 is interpositioned between the activating lever 10 and the handle grip 2.

When the intercept valve 4 is provided with an internal spring acting directly on the pusher element 6, the spring 14 may not be necessary.

The invention has important advantages.

Firstly, the activating mechanism of the invention makes the use of an intercept valve arranged in an optimal position therefor (in a position behind the grip of a spray gun) also ergonomically comfortable. Also noteworthy is the fact that the invention enables application of a type of intercept valve having the best performance, i.e. the ball-obturator valve which has coaxial inlet and outlet openings.

Finally, the activating mechanism of the invention exhibits a simple structure, which is nonetheless sturdy, highly reliable and relatively inexpensive to manufacture.

The invention claimed is:

1. A spray gun for water cleaner apparatus, comprising:

an intercepting valve; and an activating mechanism for the intercept valve, the activating mechanism comprising a manually-operated control lever hinged at a first end thereof to a pivot arranged in proximity of a handle grip of the spray gun for opening the intercepting valve, and an activating lever which acts on the intercept valve and exhibits a first end portion which is pivoted to a hinging pivot arranged in proximity of a back portion of the handle grip and a second end portion which is constrained to the control lever by a contact coupling, wherein the activating lever exhibits a length which places the second end portion in contact with the control lever along an axis passing through the pivot of the control lever and the hinging pivot of the activating lever when the spray gun is in a first rest position, wherein the first rest postion defines an arrangement of the activating mechanism corresponding to a closed position of the intercepting valve.

2. The spray gun of claim 1, wherein the control lever exhibits a groove for slidably housing the second end portion of the activating lever.

3. The spray gun of claim 1, wherein the activating lever is associated to a pin arranged in contact with a pusher element of the intercept valve.

4. The spray gun of claim 1, wherein it comprises an elastic element interpositioned between the activating lever and the handle grip for obtaining a return of the mechanism into a rest position thereof.

5. A spray gun for water cleaner apparatus, comprising:

a handle grip with a back portion;

an intercepting valve; and an activating mechanism operatively connected to the intercept valve, the activating mechanism comprising a manually-operated control lever hinged at a first end thereof to a pivot arranged in proximity of the handle grip, the control lever opening the intercepting valve, and an activating lever operatively connected to act on the intercept valve so that a first end portion is pivoted to a hinging pivot arranged in proximity of the back portion of the handle grip and a second end portion which is constrained to the control lever by a contact coupling, wherein the activating lever has a length which places the second end portion in contact with the control lever along an axis passing through the pivot of the control lever and the hinging pivot of the activating lever when the spray gun is in a first rest position.

* * * * *